US005605260A

United States Patent [19]

Olivas Coll

[11] Patent Number: 5,605,260

[45] Date of Patent: Feb. 25, 1997

[54] MACHINE FOR THE CONTROL AND BOARDING OF STOCKINGS AND TIGHTS

[75] Inventor: Javier Olivas Coll, Banyoles, Spain

[73] Assignee: Firsan, S.A., Palol De Revardit, Spain

[21] Appl. No.: 420,670

[22] Filed: Apr. 12, 1995

[30] Foreign Application Priority Data

Apr. 12, 1994 [ES] Spain ..... 9400765

[51] Int. Cl.[6] ..... D06C 5/00

[52] U.S. Cl. ..... 223/76; 68/5 D; 68/20

[58] Field of Search ..... 223/112, 60, 75, 223/76, 77; 68/5 C, 5 D, 5 E, 20

[56] References Cited

U.S. PATENT DOCUMENTS

| | | | |
|---|---|---|---|
| 2,561,210 | 7/1951 | Kohlsdorf | 223/77 |
| 3,054,542 | 9/1962 | Glaze, Jr. et al. | 223/112 |
| 3,319,851 | 5/1967 | Horberg, Jr. | 223/112 |
| 3,333,748 | 8/1967 | Horberg, Jr. | 223/112 X |
| 3,353,726 | 11/1967 | Kronsbein | 223/76 X |
| 3,811,607 | 5/1974 | Glaze, Jr. | 223/112 X |
| 4,491,255 | 1/1985 | LaChapelle | 223/77 X |
| 4,550,868 | 11/1985 | Hodges et al. | 223/112 X |
| 4,703,877 | 11/1987 | Kuniki et al. | 223/112 X |
| 4,919,315 | 4/1990 | Nakano | 223/112 X |
| 5,094,371 | 3/1992 | Takamura et al. | 223/76 |
| 5,261,579 | 11/1993 | Propach et al. | 223/77 |

FOREIGN PATENT DOCUMENTS

| | | |
|---|---|---|
| 0311888 | 4/1989 | European Pat. Off. . |
| 0518184 | 12/1992 | European Pat. Off. . |
| 2130836 | 10/1972 | France . |
| 733377 | 7/1955 | United Kingdom . |
| 2140050 | 11/1984 | United Kingdom . |
| 2181465 | 4/1987 | United Kingdom . |
| 2236545 | 4/1991 | United Kingdom . |

*Primary Examiner*—Philip R. Coe
*Attorney, Agent, or Firm*—Young & Thompson

[57] ABSTRACT

Machine for the control and boarding of stockings and tights with automatic loading and unloading of material, comprising a circular transfer type base 1 carrier for the forms 2, which can be fixed with foot inclined between approximately 5 and 15 degrees in relation to its longitudinal axis or articulated with leg extendable in width and pivoting foot 17, and a series of functional stations through which these forms successively pass, the stockings being subjected firstly to a steaming treatment in a double chamber autoclave 7 and to drying in a hot air kiln 8 divided into two parts by inner gates 35, the stockings being deposited directly on to the forms without the intervention of the intermediate transporting elements from the loading supports 13 where they are positioned by hand by the operator.

14 Claims, 3 Drawing Sheets

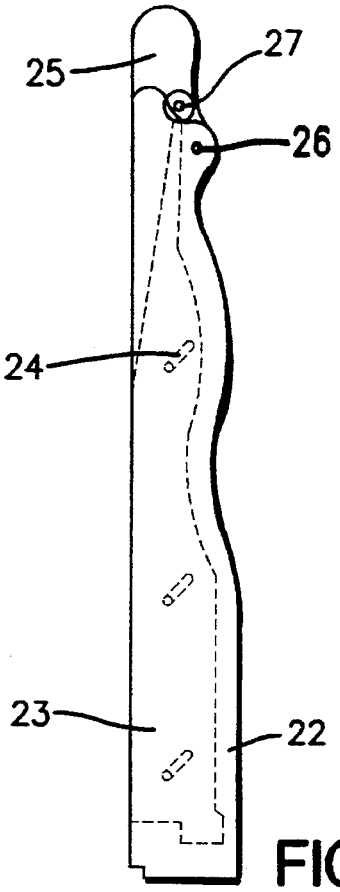
FIG. 8
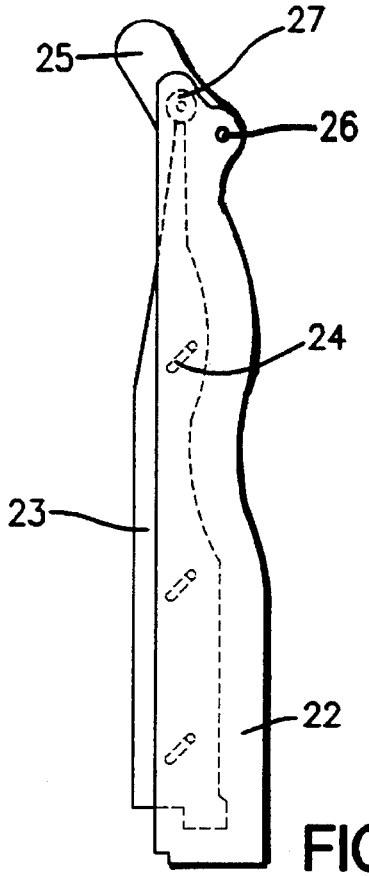
FIG. 9
FIG. 10
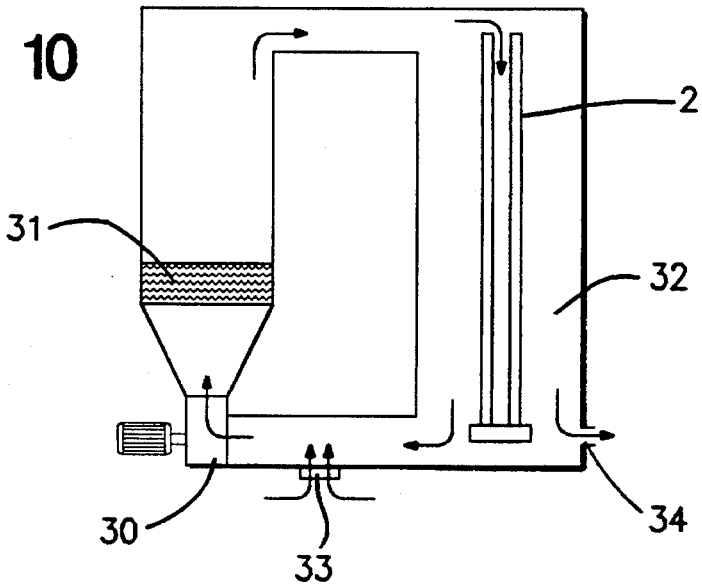

MACHINE FOR THE CONTROL AND BOARDING OF STOCKINGS AND TIGHTS

BACKGROUND OF THE INVENTION

1. Field of the Invention

The object of the present invention, as set forth in the declarations of the following descriptive report, consists in a machine for the control and boarding of stockings and tights.

This kind of machine is designed to carry out an automatic cyclical treatment on stockings and tights, following their manufacture on the corresponding legger machines. The aim of this boarding treatment is the fixing of the final shape and dimensions of the stockings, which cannot be marketed as they are when they leave the manufacturing machines, due to their crumpled and not very aesthetic appearance.

The boarding process consists in exposing the manufactured stockings to the action of steam for a specific period of time, these being mounted on forms whose shape they acquire during the steaming process. The stockings then go through a drying phase in which the excess humidity acquired during the steaming is eliminated.

The machine which is described below includes a rotating circular transfer type base for carrying the forms, which can be of a traditional fixed type, that is to say straight, fixed with foot or articulated foot type, and a series of functional stations through which these forms successively pass, the stockings being subjected to different operations from the loading and control area to the unloading area.

2. Description of the Related Art

With the current state of the technique machines for boarding stockings are known, but they have drawbacks centred on the loading and drying area.

The usual machines have loading means formed by a loading support in which the stocking is placed by the operator, a working support commonly called a form, where the stocking is positioned in order for it to be subjected to the different operations of the process, and a transporting support which collects the stocking from the loading support and deposits it in the form or working support.

Two types of form are currently used, depending on the kind of machine with which the work is being done. In both cases they are fixed forms with no movement. On the one hand there are the straight forms, without foot, which are used in machines with automatic loading and unloading, and on the other hand the fixed forms with foot, which are used in machines with manual loading and unloading, as the inclination of the foot prevents the efficient use of loading and unloading automatisms.

As far as the drying area is concerned, the existing machines currently have a kiln into which hot air is injected to dry the stockings. These kilns present a problem consisting in the fact that the recirculation of air in their interior is carried out in accordance with flows which are even at any point in the kiln, while the degree of humidity supported by the air contained is not equal at any point in its interior, it being maximum at the inlet of the kiln and minimum at the outlet.

SUMMARY OF THE INVENTION

The new machine claims to incorporate a revolutionary loading station by means of which the stockings pass directly from the loading support to the form without the need for an intermediate transporting support, thus obtaining a better positioning on the form, as there is less handling of the stocking.

It also has a revolutionary drying kiln with recirculation and renewal of air with variable flow, by means of which a more even degree of humidity is maintained on the inside of the kiln, improving its drying capacity.

Finally, a new form has been designed which, unlike the traditional fixed forms, is articulated, meaning that the stocking can be given a much more perfect form than usual without obstructing the loading and the unloading of the stocking. A new fixed form with foot has likewise been designed, the curvature of which is conceived to allow the use of automatic means of loading and unloading, while at the same time achieving an optimal shape in this area.

BRIEF DESCRIPTION OF THE DRAWINGS

With the aim of illustrating that which has been set forth thus far, three sheets of drawings accompany the present descriptive report, forming an integral part of the same, in which a purely illustrative example of performance, not restricting the practical possibilities of the invention, is shown in a simplified and schematic way.

In these drawings

FIG. 8 consists in a view of the articulated form in loading position.

FIG. 9 consists in a view of the articulated form in working position.

FIG. 10 consists in a schematic view corresponding to the drying kiln.

Figure 1:
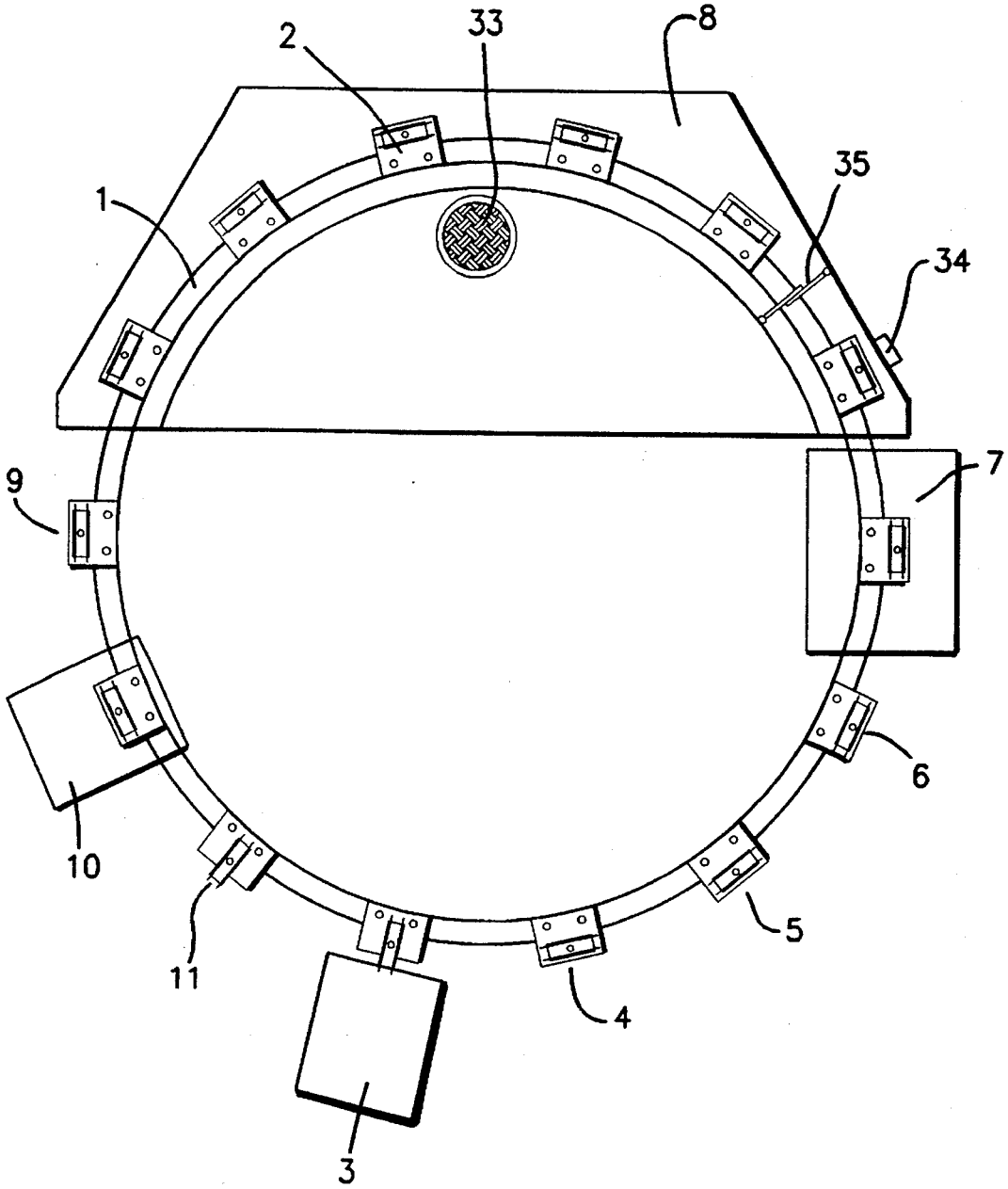
FIG. 1 consists of a general sketch of the machine.
Figure 2:
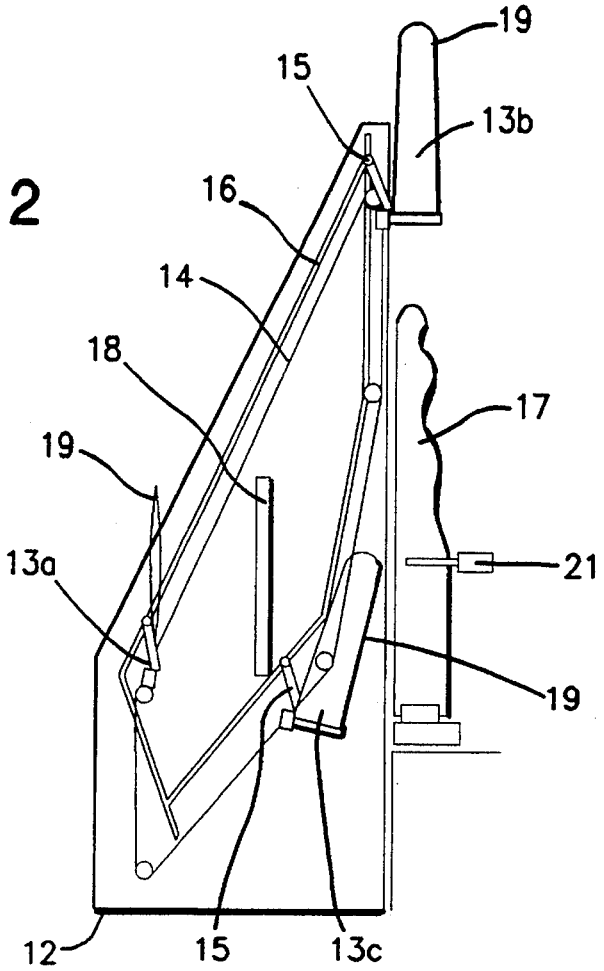
FIG. 2 consists of a sketch of the loading station.

The present machine for the control and boarding of stockings and tights consists in a rotating circular transfer type base 1 on which are fixed 14 forms 2 each of which is made up of two units, one for each leg of the stocking, which move along a series of work stations in each one of which a specific operation is carried out.

At the beginning can be found the loading and control station 3 where the stocking to be treated is loaded in radial position and at the same time a visual quality control is performed. At the second station the form turns, positioning itself at a tangent in relation to the circular base 4. The third station consists in the size regulator 5 where the stocking is stretched in order to obtain a complete emplacement on the form. The fourth station is that for tautening 6 where the tautening of the sling is proceeded with by means of pincers, in addition to the lowering of the foot from the form. The fifth station is the autoclave 7 where the steaming which will fix the shape of the form in the stocking is carried out. The sixth station consists of the drying in the hot air kiln 8. The seventh station is that for loosening 9 where the sling is loosened the foot is raised in order to ease extraction. The eighth station is that for unloading 10 where the stocking is removed from the form with the help of extractor rollers. Finally, the ninth station is the rotation of the forms 11, which go from tangential to radial position, which is the position in which they will have to enter the loading station.

The loading station consists of a bench 12 with a basically triangular profile, along which three loading supports 13*a*, 13*b*, 13*c* move, driven by two lateral drag chains 14. Each of these loading supports is guided by arms 15 which in turn move along lateral guides 16.

Both the drag chains and the guides cover a path in which four stretches can be distinguished. First comes a relatively short vertical stretch of ascent followed by a long, inclined stretch of ascent towards the upper reflex of the bench, after which there is a third stretch of vertical descent, this being the stretch in which the transfer of the stocking from the loading support to the form 17 takes place. Finally, the rough stretch is an inclined descent.

The three loading supports alternate in three positions: 13*a* manual loading position, where the operator positions the garment, immediately afterwards carrying out the quality control by inspecting it by means of the light of an internal display 18, 13*b* waiting position to carry out the transfer of the stocking on the form, 13*c* waiting position.

Figure 3:
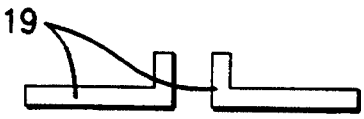
FIG. 3 consists of a sketch corresponding to the loading supports seen flat in open position.
Figure 4:
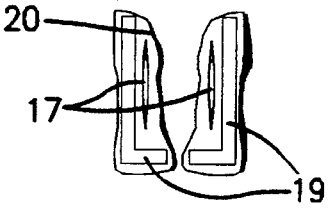
FIG. 4 consists in a sketch corresponding to the loading supports seen flat in folded position.

Between the positions 13*a* and 13*b* is the loading support, which is formed by two equal elements into each of which a leg 19 is introduced. It folds over itself, going from an extended position FIG. 3, where the two elements are on the same plane, to a folded position FIG. 4, where the two elements are arranged on two parallel planes.

Figure 5:
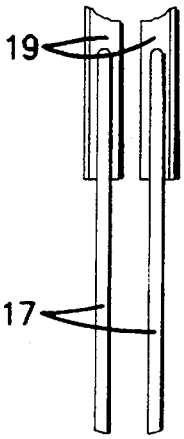
FIG. 5 corresponds to a sketch of the loading supports in folded position seen according to a lateral elevation.
Figure 6:
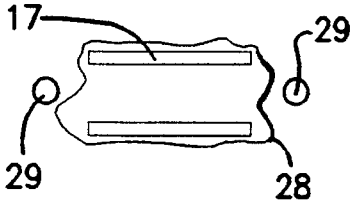
FIG. 6 corresponds to a sketch of the plan of a form in which can be seen the tautening rods of the sling in open position.
Figure 7:
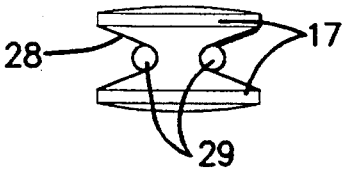
FIG. 7 corresponds to the preceding view with the rods in closed position.

Between the positions 13*b* and 13*c* the transfer of the stocking from the loading supports to the form is carried out. For this the loading supports have an L-shaped section, so that on positioning the stocking on them, it opens a minute amount, taking on a little body 20. When the supports 19 descend, the form 17 is introduced inside them and at the same time inside the stocking FIG. 4 and FIG. 5 until it reaches a point where the stocking is detected by a cell 21 and retained by means of pincers, the supports escaping through the lower part.

Finally between the positions 13*c* and 13*a* the supports unfold, again being extended and ready for the operator to load another stocking on them.

Once the form, which is in a radial position in relation to the circular base of the transfer, has been loaded, the machine moves forward one station, carrying out the rotation of the form until it is in a tangential position in relation to the circular base. This is necessary because the following operations will be carried out with the form in a tangential position.

The following important operation consists in the tautening of the stocking. For this the form has a special design which allows it to extend in addition to the lowering of the foot, so that it is possible to distinguish between a loading and unloading position FIG. 8 and a tautening position FIG. 9.

Each form is made up of four pieces, two fixed laterals 22 locked together with the mobile circular base of the machine, one movable 23 which moves between the first ones according to a path marked out by diagonal guides 24, sticking out of the front part of the fixed pieces, thus increasing the width of the assembly, and finally one pivoting piece 25 constituting the foot, which rotates on an axis 26 located in the upper part of the fixed pieces, driven by the movable piece with which it is locked together by means of a flat ball joint 27 arranged at the vertex of the same.

This operation is completed by the tautening of the sling 28, for which on the base of the forms there are two tautening rods 29. These rods tend to join together when the forms are extended, taking up the central area of the sling and moving it towards the inside of the form, leaving it taut.

The next station is that for steaming in the autoclave 7, which is characterized by having a steam chamber, thus preventing the formation of condensation liable to wet the stocking, which would lead to permanent stains on the same.

Next is the drying kiln 8, inside which there are permanently six forms. The drying is produced by circulation of hot air, driven by a ventilator 30 and heated by a radiator 31, which enters through the upper part of the drying chamber 32, and leaving on being recovered through the lower part. This kiln has one outlet with one inlet for an adjustable flow of dry air from the outside 33 and one outlet for moist air 34, the purpose of which is to be able to regulate and maintain a specific degree of humidity of the air. These elements are necessary as the recirculation of air inside the drying kiln involves an increase in the relative humidity of the air, as the water which comes from the stockings in the drying is collected by the air. The renewal of the same is therefore necessary in order to prevent the saturation of water in the recirculation air.

With the aim of optimizing this system, the drying chamber is divided into two parts by two flexible silicone gates 35 which separate the form located at the inlet of the kiln from the others, the outlet of moist air being located in the compartment corresponding to this first form. This is so that the air most loaded with humidity, which always corresponds to that which surrounds this first form, can be eliminated selectively, as this is also the one most loaded with humidity, having just left the autoclave. There is thus only real recirculation in the last five forms, as the air introduced into the subchamber which contains the first one is almost entirely expelled.

The loosening of the stocking takes place at the next station, with the rods 29 opening, the foot 25 being raised and the form being reduced again through the introduction of the movable piece 23 in the fixed piece 22.

The extraction then takes place by means of an extracting station with conventional technology, the rotation of the forms finally taking place in order to go to their radial position in relation to the circular base of the machine, thus being in position to be loaded again and for the whole process to start again.

It is worth noting that despite having illustrated the present example of operation with articulated type forms, these could be replaced by the new fixed forms with foot, equipped with a foot, inclined between 5 and 15 degrees in relation to the vertical, which will mark the shape of the stocking in this area, it being possible to carry out the loading and the extraction of the same at the same time by automatic means.

Having made the description to which the above report refers, it is now necessary to insist that the details for putting the idea exposed into effect may undergo small alterations, always based on the fundamental principles of the idea, which are in essence those reflected in the paragraphs of the description which has been made, and the claims that follow.

I claim:

1. Machine for the control and boarding of stockings and tights, comprising a rotary transfer base comprising a circular series of forms fixed at peripheral positions of said base, and a series of treatment stations positioned adjacent said transfer base such that each of said circular series of forms passes through said series of treatment stations in succession, a first said treatment station being an autoclave for steaming stockings and tights positioned on said circular series of forms, and a second said treatment station being a kiln for drying stockings and tights after passage through said autoclave, wherein a third said station is a loading station disposed upstream of said autoclave, said third loading station comprising a generally triangular frame along which several movable supports are positioned, said movable supports being driven by two lateral drag chains and guided by arms which are movable along lateral guides, thereby to transfer stockings or tights positioned on said movable supports directly to one of said circular series of forms disposed adjacent said third loading station.

2. The machine according to claim 1, wherein said two lateral drag chains and said lateral guides define a path having a first run of relatively short vertical ascent, a second relatively long inclined run of ascent toward an upper vertex of said generally triangular frame, a third relatively long run of vertical descent defining a point of transfer of a loaded stocking to a said form, and a fourth run of inclined descent.

3. The machine according to claim 1, wherein said several movable supports comprise three loading supports circulating about said triangular frame among three positions comprising a first position for manual loading, a second position for waiting to effect transfer of a stocking to one of said forms, and a third position for waiting following transfer of a said stocking to a said form and prior to reloading.

4. The machine according to claim 3, wherein a loading support is disposed between said first and second positions, said loading support comprising two elements fitted with a leg-shaped member, said loading support being movable from an extended position in which said two elements are coplanar, to a folded positioning which said two elements are disposed in parallel planes.

5. The machine according to claim 4, wherein said two elements of said loading support each have a L-shape, thereby to open up a stocking positioned on each of said elements and to facilitate entry of a said form into a loaded stocking upon decent of said supports from said second position to said third position.

6. The machine according to claim 3, further comprising means for unfolding said supports upon passage from said third position to said second position, to allow reloading of further stockings or tights thereon.

7. The machine according to claim 1, wherein each of said forms is rigid and comprises a foot portion inclined about 5° to about 15° relative to a longitudinal axis of the form.

8. The machine according to claim 1, wherein each of said circular series of forms comprises two fixed lateral pieces locked together with said rotary transfer base, a third piece mounted for relative movement between said two fixed pieces along a path defined by diagonal guides, thereby to vary a width of each said form, and a pivoting piece corresponding to a foot of the stocking or tight fitted on said form, said pivoting piece rotating about an axis passing through upper ends of the two fixed pieces, said pivoting piece being connected to said movable piece and being pivoted by movement thereof.

9. The machine according to claim 1, further comprising fourth and fifth stations intermediate said second and third stations, said fourth station effecting rotation of each said form relative to said rotary base, from a radially-outwardly extended position to a position tangential to said rotary base, said fifth station having means for stretching a stocking or tights positioned in each said form thereby completely to fit the stocking or tights to said form.

10. The machine according to claim 9, further comprising a sixth station disposed intermediate said fifth and second stations, said sixth station comprising means for tightening the fit of a stocking or tights to a said form.

11. The machine according to claim 1, wherein said autoclave comprises a steam chamber.

12. The machine according to claim 1, wherein said drying station accommodates a series of six of said circular series of forms, said drying station having an inlet for adjustable flow of dry air and an outlet for moist air, thereby to enable adjusting a humidity level of drying air.

13. The machine according to claim 12, wherein said drying station comprises a pair of flexible silicone gates dividing said drying station into two compartments, wherein a form disposed at an inlet of the drying station is separated from other forms in said drying station, said moist air outlet being disposed in a first said compartment.

14. The machine according to claim 1, further comprising a downstream station for loosening a stocking from its associated form after passage through said drying station, and a further downstream station for removing said loosened stocking from said form.

* * * * *